US009765974B2

(12) United States Patent
Wang et al.

(10) Patent No.: US 9,765,974 B2
(45) Date of Patent: Sep. 19, 2017

(54) FUEL NOZZLE

(71) Applicant: PRATT & WHITNEY CANADA CORP., Longueuil (CA)

(72) Inventors: Yen-Wen Wang, Mississauga (CA); Nigel Davenport, Hillsburgh (CA); Eduardo Hawie, Woodbridge (CA)

(73) Assignee: Pratt & Whitney Canada Corp., Longueuil (CA)

( * ) Notice: Subject to any disclaimer, the term of this patent is extended or adjusted under 35 U.S.C. 154(b) by 592 days.

(21) Appl. No.: 14/505,765

(22) Filed: Oct. 3, 2014

(65) Prior Publication Data

US 2016/0097536 A1 Apr. 7, 2016

(51) Int. Cl.
*F23R 3/28* (2006.01)
*F23D 11/10* (2006.01)

(52) U.S. Cl.
CPC ..... *F23R 3/286* (2013.01); *F23D 11/107* (2013.01); *F23R 3/28* (2013.01); *F23D 2900/11101* (2013.01)

(58) Field of Classification Search
CPC .. F23C 7/004; F23C 7/002; F23R 3/12; F23R 3/14; F23R 3/286
See application file for complete search history.

(56) References Cited

U.S. PATENT DOCUMENTS 5,813,847 A 9/1998 Eroglu et al.
6,276,141 B1 8/2001 Pelletier
6,289,676 B1 9/2001 Prociw et al.
6,289,677 B1 9/2001 Prociw et al.
7,174,717 B2 * 2/2007 Prociw ..... F23D 11/105 60/740
7,454,914 B2 11/2008 Prociw
7,568,345 B2 * 8/2009 Furletov ..... F23D 11/24 60/737
7,766,251 B2 8/2010 Mao et al.
8,096,135 B2 1/2012 Caples
2014/0090382 A1 4/2014 Sandelis et al.
2014/0090394 A1 4/2014 Low et al.

FOREIGN PATENT DOCUMENTS

JP 2010196982 A * 9/2010

* cited by examiner

*Primary Examiner* — Pascal M Bui Pho
*Assistant Examiner* — Edwin Kang
(74) *Attorney, Agent, or Firm* — Norton Rose Fulbright Canada LLP

(57) ABSTRACT

A fuel nozzle for a combustor of a gas turbine engine includes a body defining an axial direction and a radial direction, an air passageway defined axially in the body, and a fuel passageway defined axially in the body radially outwardly from the air passageway. The fuel passageway has an outer wall including an exit lip at a downstream portion of the outer wall. The exit lip has a surface treatment including a swirl-inducing relief. A gas turbine engine and a method of inducing swirl in at least one of pressurised fuel and air exiting a fuel nozzle of a gas turbine engine are also presented.

9 Claims, 4 Drawing Sheets

FUEL NOZZLE

TECHNICAL FIELD

The application relates generally to gas turbines engines combustors and, more particularly, to fuel nozzles.

BACKGROUND OF THE ART

Gas turbine engine combustors employ a plurality of fuel nozzles to spray fuel into the combustion chamber of the gas turbine engine. The fuel nozzles atomize the fuel and mix it with the air to be combusted in the combustion chamber. The atomization of the fuel and air into finely dispersed particles occurs because the air and fuel are supplied to the nozzle under relatively high pressures. The fuel could be supplied with high pressure for pressure atomizer style or low pressure for air blast style nozzles providing a fine outputted mixture of the air and fuel may help to ensure a more efficient combustion of the mixture. Finer atomization provides better mixing and combustion results, and thus room for improvement exists.

SUMMARY

In one aspect, there is provided a fuel nozzle for a combustor of a gas turbine engine, the fuel nozzle comprising: a body defining an axial direction and a radial direction; an air passageway defined axially in the body; a fuel passageway defined axially in the body radially outwardly from the air passageway, the fuel passageway having an outer wall including an exit lip at a downstream portion of the outer wall, the exit lip having a surface treatment including a swirl-inducing relief.

In another aspect, there is provided a gas turbine engine comprising: a combustor; and a plurality of fuel nozzles disposed inside the combustor, each of the fuel nozzles including: a body defining an axial direction and a radial direction; an air passageway defined axially in the body; a fuel passageway defined axially in the body radially outwardly from the air passageway, the fuel passageway having an outer wall including an exit lip at a downstream portion of the outer wall, the exit lip having a surface treatment including a swirl-inducing relief configured to induce swirl to at least one of pressurised air exiting the air passageway and pressurised fuel exiting the fuel passageway.

In a further aspect, there is provided a method of inducing swirl in at least one of pressurised fuel and air exiting a fuel nozzle of a gas turbine engine, the method comprising: carrying pressurised air through an air passageway in the fuel nozzle and carrying pressurised fuel through a fuel passageway disposed radially outwardly from the air passageway in the fuel nozzle; and directing the pressurised fuel and the pressurised air through a swirl-inducing relief formed on an exit lip of the fuel passageway and inducing swirl in at least one of the pressurised air and the pressurised fuel, the exit lip being disposed at a downstream portion of an outer wall of the fuel passageway.

DESCRIPTION OF THE DRAWINGS

Reference is now made to the accompanying figures in which.

DETAILED DESCRIPTION

Figure 1:
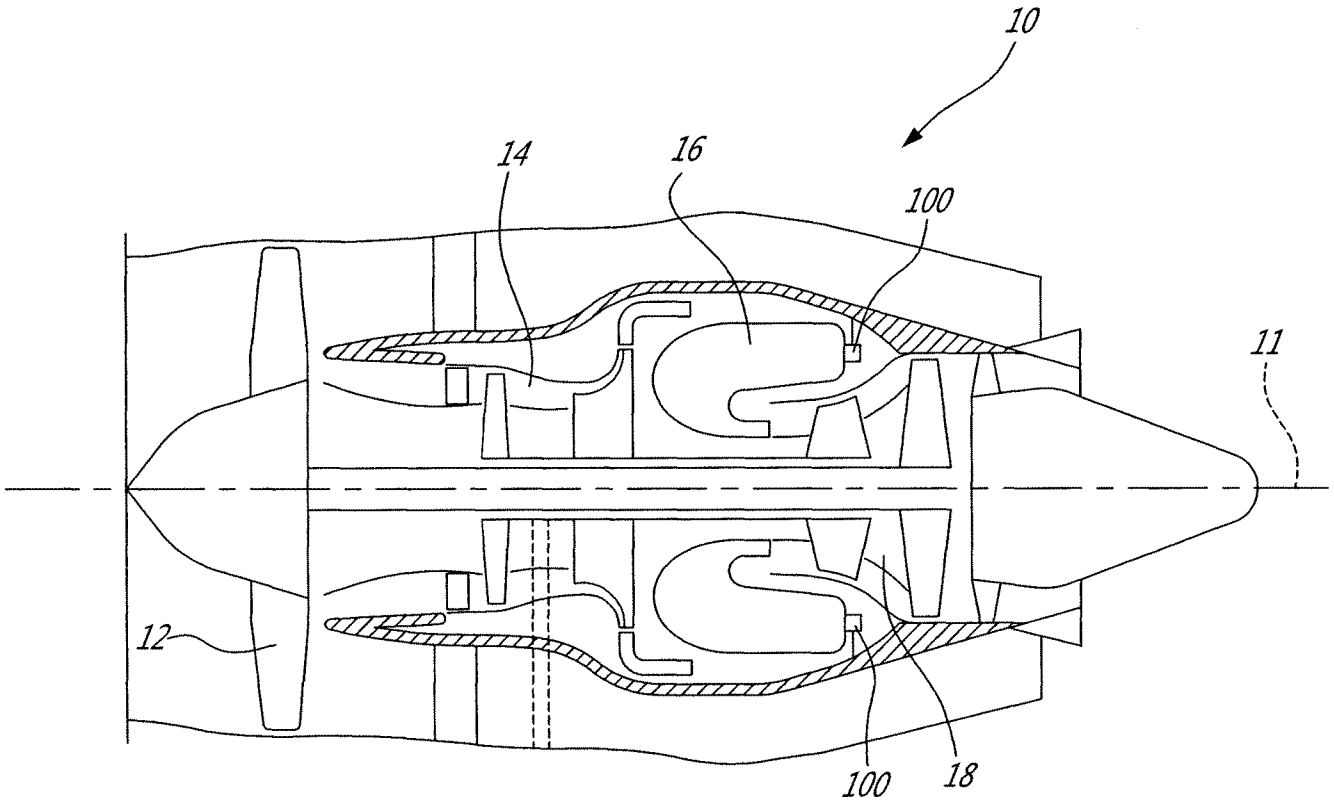
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The gas turbine engine 10 has one or more fuel nozzles 100 which supply the combustor 16 with the fuel which is combusted with the air in order to generate the hot combustion gases. The fuel nozzle 100 atomizes the fuel and mixes it with the air to be combusted in the combustor 16. The atomization of the fuel and air into finely dispersed particles occurs because the air and fuel are supplied to the nozzle 100 under relatively high pressures. The fuel could be supplied with high pressure for pressure atomizer style or low pressure for air blast style nozzles providing a fine outputted mixture of the air and fuel may help to ensure a more efficient combustion of the mixture. The nozzle 100 is generally made from a heat resistant metal or alloy because of its position within, or in proximity to, the combustor 16.

Figure 2:
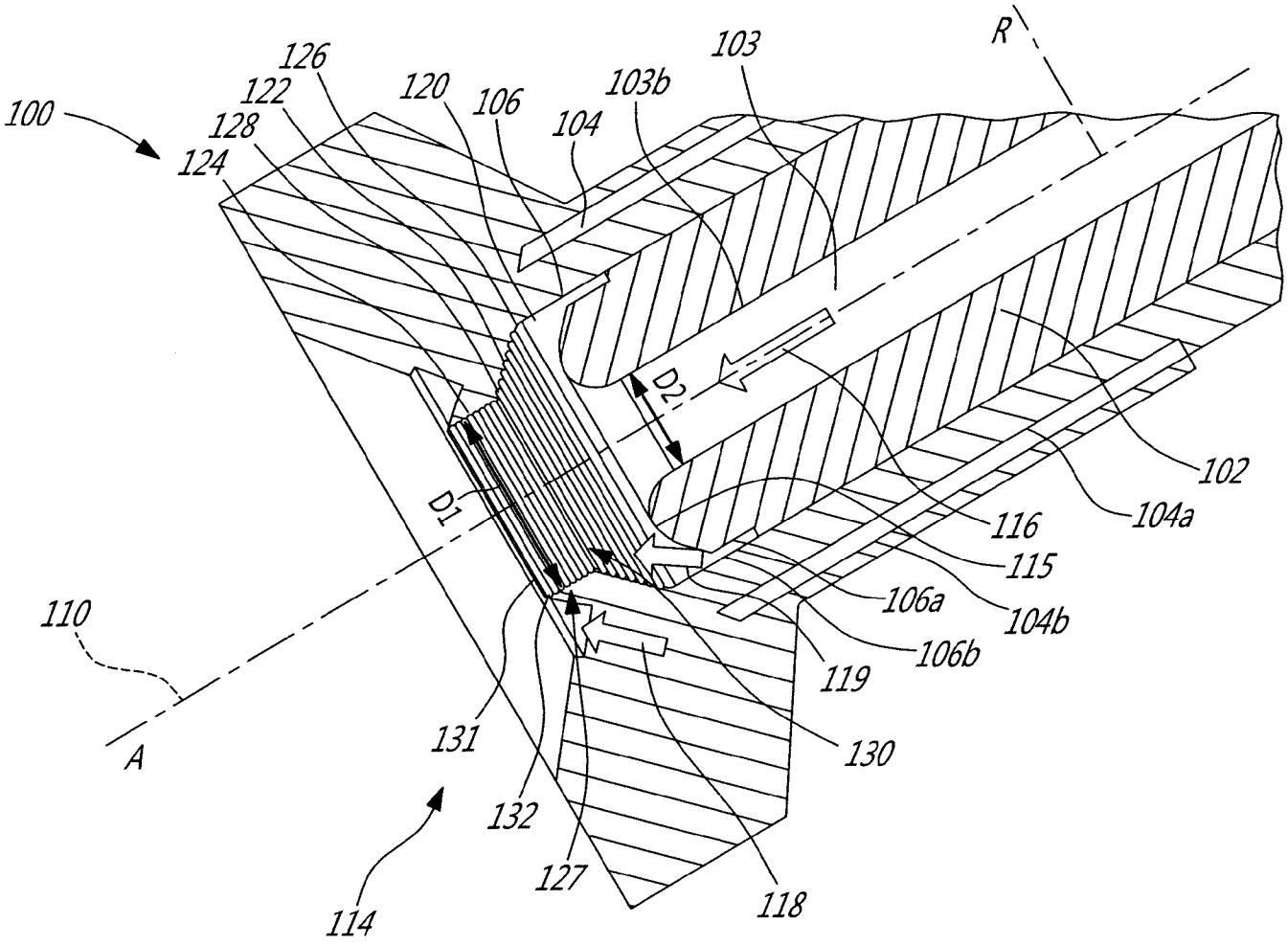
FIG. 2 is a partial schematic cross-sectional view of a first embodiment of a nozzle for a combustor of the gas turbine engine of FIG. 1.

Turning to FIG. 2, a first embodiment of the fuel nozzle 100 will now be described.

The nozzle 100 includes generally a cylindrical body 102 defining an axial direction A and a radial direction R. The body 102 is at least partially hollow and defines in its interior a primary air passageway 103 (a.k.a. core air), a secondary air passageway 104 and a fuel passageway 106, all extending axially through the body 102.

The primary air passageway 103, the secondary air passage 104 and the fuel passageway 106 are aligned with a central axis 110 of the nozzle 100. The fuel passageway 106 is disposed concentrically between the primary air passageway 103 and the secondary air passageway 104. The secondary air passageway 104 and the fuel passageway 106 are annular. It is contemplated that the nozzle 100 could include more than one primary and secondary air passageways 103, 104 and that the primary and secondary air passageways 103, 104 could have a shape of any one of a conduit, channel and an opening. The size, shape, and number of the air passageways 103, 104 may vary depending on the flow requirements of the nozzle 100, among other factors. Similarly, although one annular fuel passageway 106 is disclosed herein, it is contemplated that the nozzle 100 could include a plurality of fuel passageways 106, annular shaped or not.

The body 102 includes an upstream end (not shown) connected to sources of pressurised fuel and air and a downstream end 114 at which the air and fuel exit. The terms "upstream" and "downstream" refer to the direction along which fuel/air flows through the body 102. Therefore, the upstream end of the body 102 corresponds to the portion where fuel/air enters the body 102, and the downstream end 114 corresponds to the portion of the body 102 where fuel/air exits.

The primary air passageway 103 is cylindrical and defined by outer wall 103*b*. The primary air passageway 103 carries pressurised air illustrated by arrow 116. The air 116 will be referred interchangeably herein to as "air", "core flow of air", "jet of air", or "flow of air". The outer wall 103*b* is shown straight but it is contemplated that it could be wavy or have grooves or protrusions to induce swirl. By "swirl", one should understand any non-streamlined motion of the fluid, e.g. chaotic behavior or turbulence. The primary air passageway 103 ends at exit end 115.

The secondary air passageway 104 is defined by inner wall 104*a* and outer wall 104*b*. The secondary passageway 104 could be wavy or leave protrusions or grooves to induce swirl. The secondary air passageway 104 carries pressurised air illustrated by arrow 118. The air 118 will be referred interchangeably herein to as "annular film of air", "flow of air", "flow", or "air".

The fuel passageway 106 is defined by inner wall 106*a* and outer wall 106*b*. The fuel passageway 106 carries pressurised fuel illustrated by arrow 119. The fuel 119 will be referred interchangeably herein to as "fuel film", or "fuel". The inner wall 106*a* ends with the exit end 115 of the primary air passageway 103, while the outer wall 106*b* extends downstream relative to the inner wall 106*a*. The outer wall 106*b* of the fuel passage 106 is defined at the downstream end 114 by a first axial portion 120, a second converging portion 122 extending from a downstream end 126 of the axial portion 120, and a third axial portion 124 extending from a downstream end 128 of the converging portion 122. The third axial portion 124 forms an exit lip 127 of the nozzle 100 through which the fuel 119 is expelled into the combustor 16. The exit lip 127 is disposed downstream from the exit end 115 of the primary air passageway 103. A diameter D1 of the outer wall 106*b* at the third axial portion 124 is slightly bigger than a diameter D2 of the outer wall 103*b* of the primary air passageway 103.

The secondary air passageway 104 and the fuel passage 106 are typically convergent (i.e. its cross-sectional area may decrease along its length, from inlet to outlet) in the downstream direction at the downstream end 114. The outer wall 106*b* of the fuel passageway 106 converging at the downstream end 114 forces the annular fuel film 119 expelled by the fuel passageway 106 onto the jet of air 116 from primary air passageway 103. Similarly, the outer wall 104*b* of the secondary air passageway 104 are converging at the downstream end 114, thereby forcing the annular film of air 118 expelled by the secondary air passageway 104 onto the annular film of fuel expelled by the fuel passageway 106. At the downstream end 114, the annular fuel film 119 is impacted by the core flow of air 116 of the primary air passageway 103 and the annular flow of air 118 of the secondary air passageway 104. The flows 116, 118 having different velocities than the fuel 119 shear the fuel 119 and facilitate its break down into droplets (i.e. atomization).

The second converging portion 122 and the third axial portion 124 (i.e. exit lip 127) have a surface treatment including a swirl-inducing relief in the shape of a plurality of grooves 130. The grooves 130 define a plurality of ridges 131 between them. The ridges 131 form transitions in the outer wall 106*b* and induce swirl in the core flow of air 116 as it exits the air passageway 103. The grooves 130 induce a swirl in the annular fuel film 119 as it exits the first axial portion 120 of the fuel passage 106 and gets in contact with the core flow of air 116. The grooves 130 are formed in the third axial portion 124 up to a downstream end 132 of that portion (i.e. downstream end of exit lip 127). In the embodiment shown in the Figures, the grooves 130 are circumferential, helicoidal and of round cross-section. It is contemplated that the grooves 130 could have various shapes, for example, the grooves 130 could be axial, circular, of a rectangular cross-section, or of a triangular cross-section. The grooves 130 could be more or less thick. The grooves 130 could even be replaced by ridges (or various protrusions). An example of said protrusion is shown and described in FIG. 3. It is contemplated that the grooves 130 could be disposed only on the third axial portion 124 or on a downstream portion thereof. It is also contemplated that the grooves 130 could be disposed on the third axial portion 124 and on a portion of the second converging portion 122. The grooves 130 could be continuous or discontinuous.

By inducing swirl to the fuel film 119, turbulence or a chaotic behavior to the fuel film 119 develops as the fuel film exits the lip 127. A thickness of the fuel film 119 may thus be reduced, and in turn mixing of the fuel 119 with the air 116, 118 from the primary and secondary air passageways 103,104 is increased. The increase of the mixing may reduce a size of the droplets of fuel formed, favours atomization, and as a result enhances combustion. In addition, the ridges 131 define relatively sharp edges of the outer wall 106*b* and may act as fuel atomization sites, which in turn may increase a number of the available atomization sites for the fuel to enhance combustion compared to if the grooves 130 were not present.

The grooves 130 may be easily machined into the nozzle 100. They may allow to improve the nozzle atomization performance without changing the nozzle overall geometrical envelope or altering the nozzle air-distribution.

Figure 3:
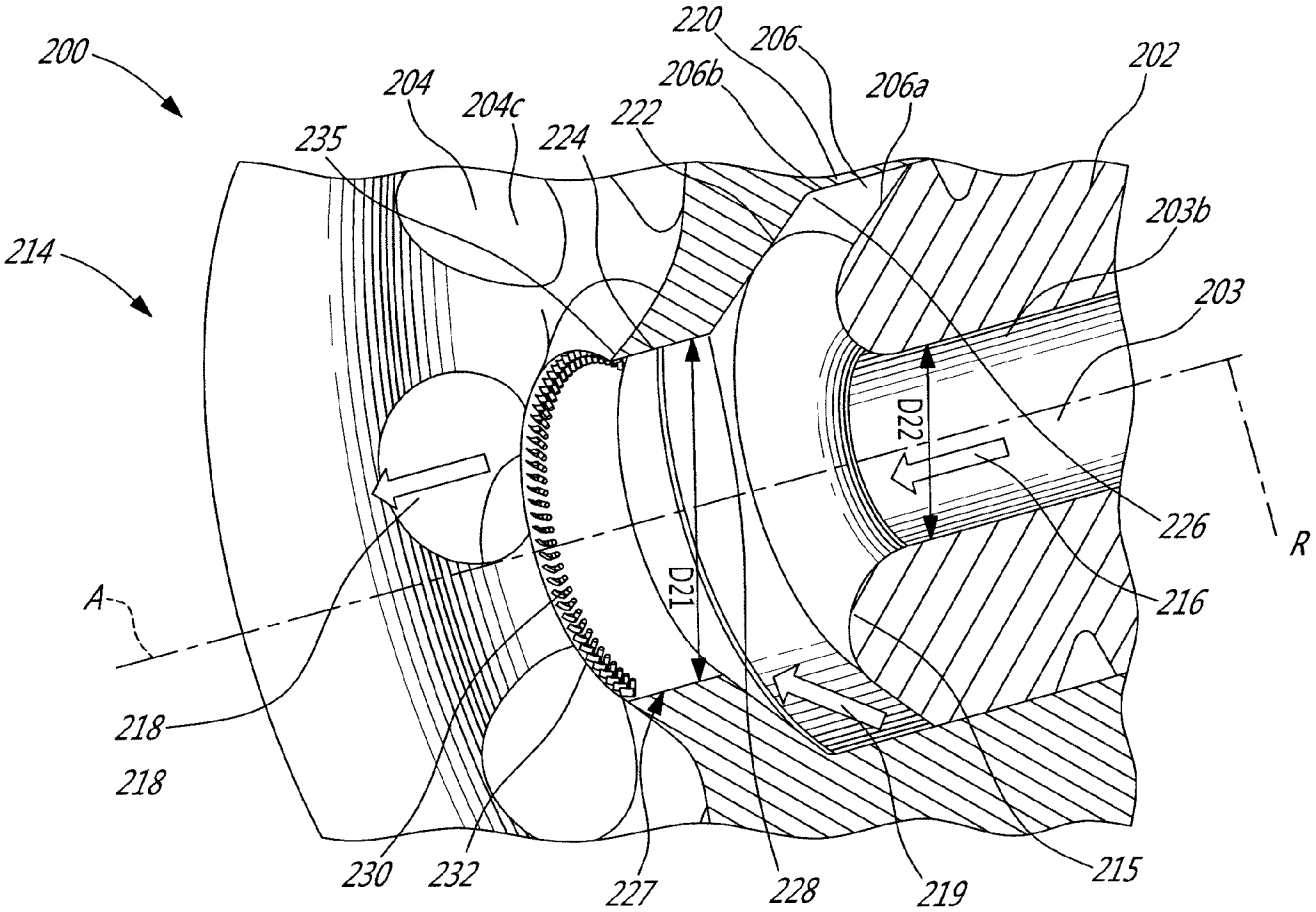
FIG. 3 is a partial schematic cross-sectional view of a second embodiment of a nozzle for the combustor of the gas turbine engine of FIG. 1.

Turning now to FIG. 3, a second embodiment of a fuel nozzle 200 will be described.

The nozzle 200 includes generally a cylindrical body 202 defining an axial direction A and a radial direction R. The body 202 is at least partially hollow and defines in its interior a primary air passageway 203 (a.k.a. core air), a secondary air passageway 204 and a fuel passageway 206, all extending axially through the body 202.

The primary air passageway 203, the secondary air passage 204 and the fuel passageway 206 are axially defined in the body 202. The fuel passageway 206 is disposed concentrically between the primary air passageway 203 and the secondary air passageway 204. The secondary air passageway 204 and the fuel passageway 206 are annular. It is contemplated that the nozzle 200 could include more than one secondary air passageway 204 and that the secondary air passageway 204 could have a shape of any one of a conduit, channel and an opening. The size, shape, and number of the fuel passageway 206 and air passageways 203, 204 may vary depending on the flow requirements of the nozzle 200, among other factors.

The body 202 includes an upstream end (not shown) connected to sources of pressurised fuel and air and a downstream end 214 at which the air and fuel exit. The terms "upstream" and "downstream" refer to the direction along which fuel/air flows through the body 202. Therefore, the upstream end of the body 202 corresponds to the portion where fuel/air enters the body 202, and the downstream end 214 corresponds to the portion of the body 202 where fuel/air exits.

The primary air passageway 203 is defined by outer wall 203*b*. The primary air passageway 203 carries pressurised air illustrated by arrow 216. The air 216 will be referred interchangeably herein to as "air", "core flow of air", or "jet of air". The outer wall 203*b* is shown straight but it is contemplated that it could be wavy or have grooves or protrusions to induce swirl. The primary air passageway 203 ends at exit end 215.

The secondary air passageway 204 is defined by an inner wall and an outer wall (not shown), and has a plurality of round exits 204*c*. The secondary air passageway 204 carries pressurised air illustrated by arrow 218. The air 218 will be referred interchangeably herein to as "flow of air", or "air".

The fuel passageway 206 is defined by inner wall 206*a* and outer wall 206*b*. The fuel passageway 206 carries pressurised fuel illustrated by arrow 219. The fuel 219 will be referred interchangeably herein to as "fuel film", or "fuel". The inner wall 206*a* is wavy. It is contemplated that the fuel passageway 206 could be straight or have various swirl-inducing reliefs on either or both of the inner wall 206*a* or outer wall 206*b*. The outer wall 206*b* of the fuel passage 206 includes a first axial portion 220, a second converging portion 222 extending from a downstream end 226 of the axial portion 220, and a third axial portion 224 extending from a downstream end 228 of the converging portion 222. The third axial portion 224 forms an exit lip 227 of the nozzle 200. The exit lip 227 is disposed downstream from the exit end 215 of the primary air passageway 203. A diameter D21 of the outer wall 206*b* at the third axial portion 224 is slightly bigger than a diameter D22 of the outer wall 203*b* of the primary air passageway 203.

The fuel passageway 206 is typically convergent (i.e. its cross-sectional area may decrease along its length, from inlet to outlet) in the downstream direction at the downstream end 214, thereby forcing the annular film of fuel 219 expelled by the fuel passageway 206 onto the jet of air 216 of the primary air passageway 203. At the downstream end 214, the annular film of fuel 219 is impacted by the core flow of air 216 of the primary air passageway 203 and the annular flow of air 218 of the secondary air passageway 204.

The exit lip 227 of the fuel passageway 206 has a surface treatment including a swirl-inducing relief in the form of a plurality of vanes 230 disposed in a circumferential array at a downstream end 232 of the exit lip 227. The vanes 230 extend radially inwardly from the outer wall 206*b* at the exit lip 227 toward the axial axis A.

Figure 4B:
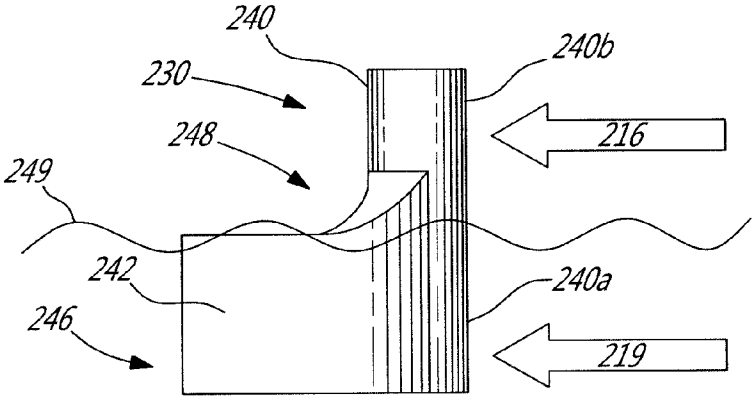
FIGS. 4A to 4D are schematic views of vanes for the nozzle of FIG. 3.
Figure 4D:
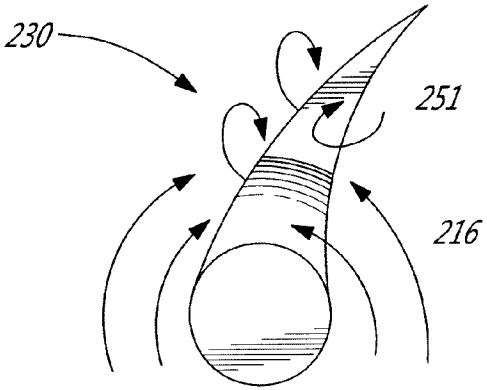
Figure 4A:
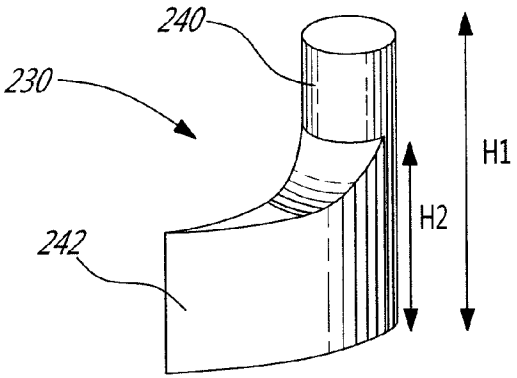
Figure 4C:
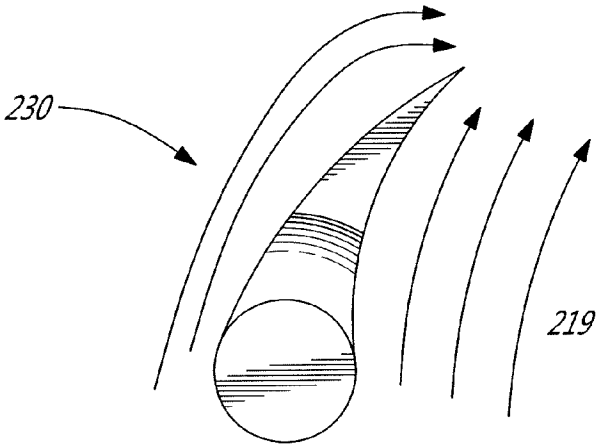

Referring to FIGS. 4A to 4D each of the vanes 230 includes a pin 240 and an airfoil portion 242 extending downstream from the pin 240. The pin 240 has a generally circular cross-section. The vanes 230 are impacted by the air 216 from the primary air passageway 203 and the fuel film 219 from the fuel passageway 206. The primary air passageway 203 being disposed concentrically inside the fuel passageway 206, a first portion 246 of the vane 230 is impacted by fuel 219 only and a second portion 248 of the vane 230 is impacted by air 216 only. The pin 240 has a radial height H1 bigger than a radial height H2 of the airfoil portion 242. As best shown in FIG. 4B, in one embodiment, a transition between the radial height H1 and the radial height H2 is smooth (i.e. curved). The radial height H2 may be chosen to correspond to a radial height at which the vane 230 is impacted by fuel 219 only. As a result, the first portion 246 of the vane 230 impacted by fuel 219 only includes a lower portion 240*a* of the pin 240 and the airfoil portion 242. The second portion 248 of the vane 230 impacted by air only includes an upper portion 240*b* of the pin 240 only (i.e. no airfoil portion 242). A virtual separation between the air 216 and the fuel 219 impacting the vane 230 is illustrated by wavy line 249 in FIG. 4B. An orientation of the vanes 230 may be set to match a fuel injection angle.

Having a different structure of the vane 230 depending whether it is affected by air 216 or fuel 219, allows to modulate the effect of the vane 230 on the air 216 and fuel 219. In the example shown in the figures, the circular cross-section of the pin 240 induces turbulence and recirculation/swirl (indicated by arrow 251) downstream of the pin 240 (see FIG. 4D). The turbulence may enhance atomization of the fuel 219. The airfoil portion 242, however, having a streamlined shape, boundary layer and turbulence are minimized. Recirculation of the fuel 219 may be avoided to favor fuel velocity increase and thus shear between the air 216 and the fuel film 219. Minimizing the recirculation zone of the fuel 219 may also prevent coking.

The vanes 230 could have various shapes. For example, the airfoil portion 242 could be omitted, or the pin 240 could have a same radial height as the airfoil portion 242. The vanes 230 could also be designed independently of the virtual separation 249 between the air 216 and the fuel film 219. The vanes 230 could also induce turbulence in both the fuel 219 and the air 216. There could be more than one row of vanes 230, and the vanes 230 may not be disposed circumferentially.

The above description is meant to be exemplary only, and one skilled in the art will recognize that changes may be made to the embodiments described without departing from the scope of the invention disclosed. Other modifications which fall within the scope of the present invention will be apparent to those skilled in the art, in light of a review of this disclosure, and such modifications are intended to fall within the appended claims.

The invention claimed is:

1. A fuel nozzle for a combustor of a gas turbine engine, the fuel nozzle comprising:
- a body defining an axial direction and a radial direction;
- an air passageway defined axially in the body;
- an exit lip disposed axially downstream relative to a downstream end of the air passageway; and
- a fuel passageway defined axially in the body and radially outwardly from the air passageway, the fuel passageway having an outer wall forming the exit lip, a plurality of vanes extending radially inwardly from the exit lip, each of the plurality of vanes comprising:
- a pin extending radially inwardly from the exit lip, the pin having a first radial height configured to be disposed mainly across a flow of pressurized air; and
- an airfoil portion extending downstream from the pin, the airfoil portion having a second radial height configured to be disposed mainly across a flow of pressurized fuel.

2. The fuel nozzle of claim 1, wherein each of the plurality of vanes extends up to a downstream end of the exit lip.

3. The fuel nozzle of claim 1, wherein the plurality of vanes are disposed in a circumferential array.

4. The fuel nozzle of claim 1, wherein only the airfoil portion is streamlined.

5. The fuel nozzle of claim 1, wherein the second radial height of the airfoil portion is smaller than the first radial height of the pin.

6. A gas turbine engine comprising:
- a combustor; and
- a plurality of fuel nozzles disposed inside the combustor, each of the fuel nozzles including:
- a body defining an axial direction and a radial direction;
- an air passageway defined axially in the body; and
- a fuel passageway defined axially in the body and radially outwardly from the air passageway, the fuel passageway having an outer wall including an exit lip at a downstream portion of the outer wall, the exit lip having a plurality of vanes extending radially inwardly from the exit lip, each of the plurality of vanes comprising:

a pin extending radially inwardly from the exit lip, the pin having a first radial height being disposed mainly across a flow of pressurized air exiting the air passageway; and an airfoil portion extending downstream from the pin, the airfoil portion having a second radial height being disposed mainly across a flow of pressurized fuel exiting the fuel passageway.

7. The gas turbine engine of claim 6, wherein each of the plurality of vanes extends up to a downstream end of the exit lip.

8. A method of inducing swirl in at least one of pressurised fuel and air exiting a fuel nozzle of a gas turbine engine, the method comprising:

carrying pressurised air through an air passageway in the fuel nozzle and carrying pressurised fuel through a fuel passageway disposed radially outwardly from the air passageway in the fuel nozzle; and directing the pressurised fuel and the pressurised air through a plurality of vanes extending radially inwardly from an exit lip of the fuel passageway, the exit lip being disposed at a downstream portion of an outer wall of the fuel passageway, each of the plurality of vanes comprising:

a pin extending radially inwardly from the exit lip, the pin having a first radial height configured to be disposed mainly across a flow of pressurized air exiting the air passageway; and an airfoil portion extending downstream from the pin, the airfoil portion having a second radial height configured to be disposed mainly across a flow of pressurized fuel exiting the fuel passageway; and using the plurality of vanes to induce swirl in at least one of the pressurised air and the pressurised fuel.

9. The method of claim 8, wherein directing the pressurised fuel and the pressurised air through the plurality of vanes comprises directing the pressurised fuel through the airfoil portions of the plurality of vanes and directing the pressurised air through the pins of the plurality of vanes.

* * * * *